United States Patent [19]

Whitney

[11] Patent Number: 4,930,529

[45] Date of Patent: Jun. 5, 1990

[54] CUTICLE TREATMENT DEVICE AND METHOD

[76] Inventor: James H. S. Whitney, 114 Fairway Dr., Harrisonburg, Va. 22801

[21] Appl. No.: 203,054

[22] Filed: May 16, 1988

[51] Int. Cl.[5] ..... A45D 29/00

[52] U.S. Cl. ..... 132/73; 132/76.5; 206/581

[58] Field of Search ..... 132/73, 76.5, 73.5; 206/581

[56] References Cited

U.S. PATENT DOCUMENTS

| | | | |
|---|---|---|---|
| 902,546 | 11/1908 | Amory . | |
| 2,219,597 | 10/1940 | Lutz | 132/73 |
| 2,399,463 | 4/1946 | Bryant . | |
| 2,615,453 | 1/1951 | Ohman . | |
| 2,876,782 | 7/1955 | Hudgens . | |
| 3,339,562 | 9/1967 | Rowe | 132/76 |
| 4,033,363 | 7/1977 | LaCourte . | |
| 4,559,957 | 12/1985 | Hokama | 132/73 |
| 4,770,195 | 9/1988 | Dore | 132/73 |

*Primary Examiner*—Kenneth J. Dorner

*Assistant Examiner*—J. Hakomaki

*Attorney, Agent, or Firm*—Mason, Fenwick & Lawrence

[57] ABSTRACT

A cuticle treatment apparatus comprises a manicuring instrument comprising an elongated shaft having first and second blades extending from the ends of the shaft; a plurality of first and second covers for removably covering the first and second ends, respectively, the first and second covers being made from an absorbent material and being impregnated with a skin moisturizer; a plurality of pads made from an absorbent material and being impregnated with a skin moisturizer for softening the cuticle to be treated prior to use of the instrument; and a container for holding the instrument, the covers, and the pads. A method for treating cuticles comprises providing a manicuring instrument with a skin moisturizer to the cuticle while the cuticle is being worked by the instrument; providing at least one pad impregnated with a skin moisturizer; softening the cuticle by massaging it with the pad for a period of time; removing the pad; and simultaneously providing skin moisturizer to the cuticle and working the cuticle using the manicuring instrument and the associated moisturizer.

18 Claims, 1 Drawing Sheet

CUTICLE TREATMENT DEVICE AND METHOD

BACKGROUND OF THE INVENTION

The present invention is directed to the field of manicuring equipment, and is more specifically directed to a cuticle treatment device and container therefor, and a method of treating cuticles.

Cuticle instruments for pushing and shaping the cuticle have been made in a number of forms typified by U.S. Pat. No. 902,546 to Amory; U.S. Pat. No. 2,615,453 to Ohman; and U.S. Pat. No. 4,559,957 to Hokama. Such instruments typically consist of an elongated stem having a blade at one or both ends for pushing and shaping the cuticle. However, as the skin comprising the cuticle is frequently dry or hard, a moisturizing cream or liquid typically is applied to the cuticle before use of the cuticle instrument. This has been accomplished in the past by cuticle instruments incorporating a reservoir for dispensing a liquid or cream to the fingernail and cuticle prior to beginning work on the cuticle. Devices of this type are disclosed in U.S. Pat. No. 2,399,463 to Bryant; U.S. Pat. No. 2,876,782 to Hudgens; and U.S. Pat. No. 4,033,363 to LaCourte.

Bryant discloses a device which incorporates a material 25 with a cellular structure for retaining a liquid which protrudes from the instrument at a point 26 on the underside 19 of the cuticle-working instrument 14. The liquid is applied to the cuticle or the nail by pressing the portion 26. The device is then rotated 180< to apply the rounded surface of cuticle-working instrument 14 to the cuticle. In all of the above-mentioned devices, the application of the liquid or cream and the working of the cuticle is at least a two-step operation, replenishment of the supply of cream or liquid requiring the manicurist to stop working the cuticle to dispense more cream or liquid. Moreover, these devices do not permit a readily controlled amount of cream or liquid to be dispensed. The dispensing of too much liquid or cream either from a bottle or tube or one of the devices incorporating a reservoir can result in an excess being dispensed, which must first be removed if the cuticle is to be worked without creating a mess, and which is also wasteful of the cream or liquid.

In summary, no simple method and device exist for treating cuticles, which continuously provide moisturizing cream or liquid to the cuticle being treated and which do not require separate steps for the application of the cream or liquid and the treatment of the cuticle. It is the solution of these and other problems to which the present invention is directed.

SUMMARY OF THE INVENTION

Therefore, it is the primary object of this invention to provide a method and apparatus for treating cuticles in which a moisturizing cream or liquid is applied continuously to the cuticles during treatment.

It is another object of this invention to provide a method and apparatus for treating cuticles in which a moisturizing cream or liquid can be applied to the cuticles before and after the cuticles are worked.

The foregoing and other objects of the invention are achieved by provision of a cuticle treatment device comprising a manicuring instrument having first and second blades extending from either end and medicated removable covers for use on the blades. In one aspect of the invention, the first blade is substantially V-shaped, having inwardly tapering sides and a blunt end, and a second blade is substantially U-shaped, having substantially parallel sides and an arcuate end. Each blade has a face which is gently concave in the lengthwise direction of the manicuring instrument. In another aspect of the invention, the cuticle treatment device further comprises medicated pads for application of moisturizing cream or liquid to the fingernails and cuticles before and after working of the cuticles. In still another aspect of the invention, a container is provided for the manicuring instrument, removable covers, and medicated pads.

A method for treating cuticles using the inventive apparatus comprises providing a medicated pad impregnated with a moisturizing cream or liquid and a manicuring instrument including means for continuously applying cream or liquid to the cuticles during treatment, applying the cream or liquid to the nail or cuticle for a period of time by massaging the nail and cuticle with a medicated pad, pushing and working the cuticle and simultaneously applying cream or liquid thereto using the manicuring instrument, and subsequently applying liquid or cream to the nail or cuticle for a period of time by again massaging the nail and cuticle with a medicated pad.

A better understanding of the disclosed embodiments of the invention will be achieved when the accompanying detailed description is considered in conjunction with the appended drawings, in which like reference numerals are used for the same parts as illustrated in the different figures.

DESCRIPTION OF THE PREFERRED EMBODIMENTS

Figure 1:
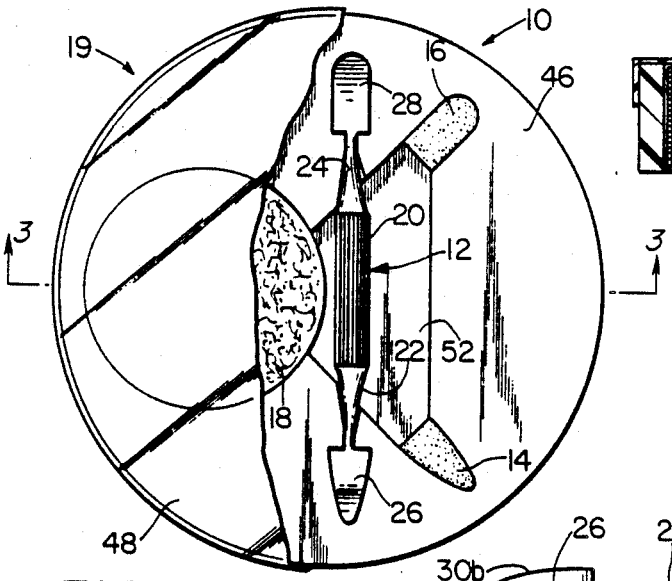
FIG. 1 is a top plan view of a first embodiment of the invention, with a portion of the lid partially broken away.
Figure 3:
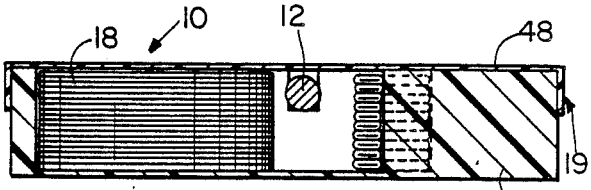
FIG. 3 is a cross-sectional view taken along line 3—3 of FIG. 1.
Figure 4:
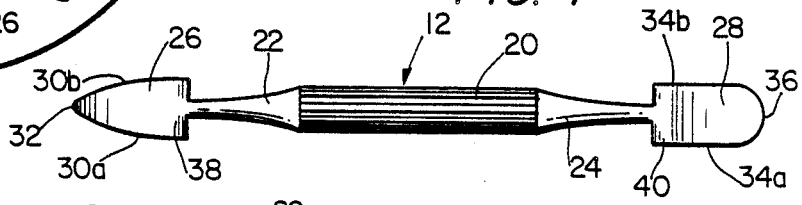
FIG. 4 is a top plan view of the manicuring instrument of the invention.
Figure 5:
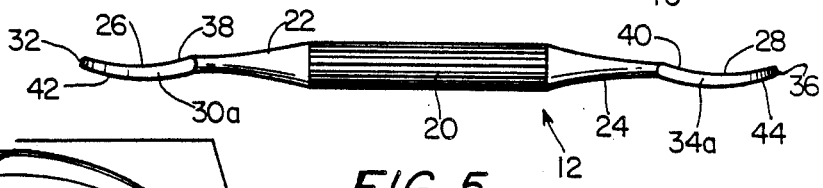
FIG. 5 is a side elevational view of the manicuring instrument shown in FIG. 4.
Figure 2:
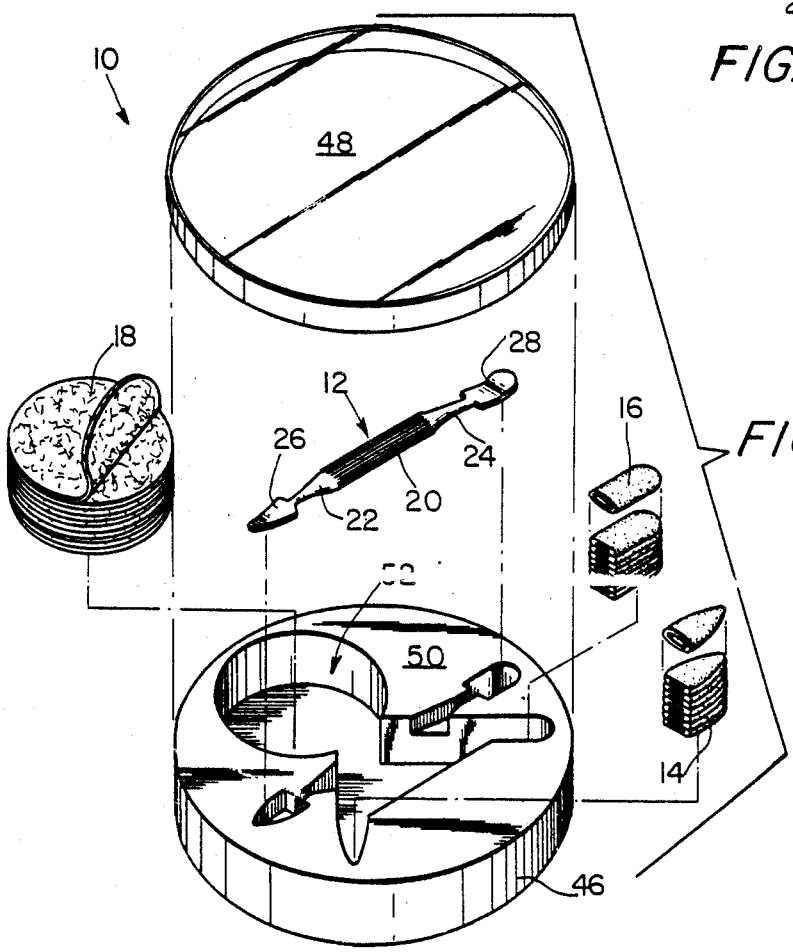
FIG. 2 is an exploded side perspective view of the embodiment shown in FIG. 1.

Referring now to FIGS. 1–5, there is illustrated a preferred embodiment of a cuticle treatment device, generally designated by the reference numeral 10. Cuticle treatment device 10 comprises a manicuring instrument 12, a plurality of medicated removable covers 14 and 16 for use on manicuring instrument 12, a plurality of medicated pads 18, and a container 19 for holding instrument 12, covers 14 and 16, and pads 18.

Instrument 12 comprises an elongated shaft 20 having opposed first and second ends 22 and 24, and first and second blades 26 and 28 extending from first and second ends 22 and 24, respectively. Removable first and second covers 14 and 16 fit over first and second blades 26 and 28, respectively.

Shaft 20 can have a cylindrical transverse cross-section as shown, or an oval transverse cross-section, or a polygonal transverse cross-section, such as octagon. If a cylindrical or oval transverse cross-section is used, preferably the surface of shaft 20 is knurled, ribbed, grooved, or otherwise to prevent it from rolling or slipping while in use.

First and second ends 22 and 24 of instrument 12 are substantially hyperboloidal or frusto-conical, tapering inwardly to their juncture with blades 26 and 28. Blades 26 and 28 preferably have different shapes as shown for performing different functions; i.e., first blade 26 is substantially V-shaped, having inwardly tapering sides 30*a* and 30*b* and a blunt end 32 for cleaning under the nails and for working the side edges of the nail and the outer ends of the cuticle, while second blade 28 is substantially U-shaped, having substantially parallel sides 34*a* and 34*b* and an arcuate end 36 for pushing the cuticle. Alternatively, instrument 12 could be made with two blades having the same shape as blade 28.

Blades 26 and 28 have respective first faces 38 and 40 which are gently concave in the lengthwise direction of shaft 20 and respective second faces 42 and 44 which are gently concave in the lengthwise direction of shaft 20. As shown, first faces 38 and 40 lie on the same side of the lengthwise axis of instrument 12. Alternatively, first faces 38 and 40 can lie on opposite sides of the lengthwise axis of instrument 12; i.e., blades 26 and 28 can curve in opposite directions.

Sides 30*a* and 30*b* and end 32 form sharp edges with first and second faces 38 and 42 of blade 26, and sides 34*a* and 34*b* and end 36 form sharp edges with first and second faces 40 and 44 of blade 28 so that blades 26 and 28 can effectively push the cuticle.

Preferably, manicuring instrument 12 is integrally formed of molded plastic, so that it can be easily and inexpensively made and can be disposed of after several uses.

First and second covers 14 and 16 are shaped to conform to first and second blades 26 and 28, respectively, with one side open to receive first and second blades 26 and 28, respectively. Covers 14 and 16 are formed of a fiber material, such as that used for paper towels, or any other material which is sufficiently absorbent to be readily impregnated with a moisturizer, and sufficiently strong to prevent tearing and/or separation of the material during normal use. Because covers 14 and 16 are intended to be disposable, they should also be made from a material which is sufficiently inexpensive that it can be disposed of after a single use.

Pads 18 are formed of the same material as covers 14 and 16, so as also to be readily impregnated with a moisturizer and to be disposable. Pads 18 can be round as shown or any other convenient shape.

The moisturizer for use with covers 14 and 16 and pads 18 can be a cream or liquid which is capable of being absorbed by and impregnating covers 14 and 16 and pads 18, or a cream which is melted to be capable of being absorbed by and impregnating covers 14 and 16 and pads 18.

Container 20 comprises a base 46 for receiving tool 12, covers 14 and 16, and pads 18, and a lid 48 for covering base 46. Base 46 can be formed as shown with a top surface 50 having a recess 52 formed therein conforming in part to the shape of instrument 12, covers 14 and 16, and pads 18, and of sufficient depth for receiving tool 12, a plurality of covers 14 and 16, and a plurality of pads 18, respectively.

In a model made to test operability of the invention, instrument 12 was approximately 7.6 cm long overall, with shaft 20 being 2.54 cm long, ends 22 and 24 being 1.25 cm long, and blades 26 and 28 being 1.27 cm long, 0.64 cm wide, and 0.16 cm high. Covers 14 and 16 and pads 18 were made from paper toweling material approximately 0.08 cm thick. Covers 14 and 16 had substantially the same width and length as blades 26 and 28, while pads 18 were circular, with a diameter of 3.8 cm. The moisturizer was a commercial cream having as its active ingredients octyl dimethyl PABA, benzophenone, and dimethicone in an emollient, melted down to make it capable of being absorbed by covers 14 and 16 and pads 18.

In the inventive method, the cuticles and the skin at the edges of the nail are softened by applying the moisturizer to the cuticles and skin surrounding the nail with a pad 18. The pad 18 is used to massage the cuticle and skin surrounding the nail for a period of time, for example 5–10 minutes, which depends upon how dry and cracked the cuticles and skin surrounding the nail are. Next, covers 14 and 16 are applied to blades 26 and 28, respectively, and blades 26 and 28 together are used to push the cuticle back from off the fingernail. The same or a new pad 18 is then used to apply a final application of the moisturizer to the cuticle and skin surrounding the nail, by again massaging the cuticle and skin with pad 18 for an additional period of time, to complete the softening process.

Thus, it will be seen that the present invention provides a unique method and apparatus for cuticle treatment. While preferred embodiments of the invention have been disclosed, it should be understood that the spirit and scope of the invention are to be limited solely by the appended claims, since numerous modifications of the disclosed embodiment will undoubtedly occur to those of skill in the art.

I claim:

1. Cuticle treatment apparatus comprising:

a manicuring instrument comprising an elongated shaft having opposed first and second ends and first and second blades extending from said first and second ends, respectively and first and second cover means for removably covering said first and second blades, respectively, said first and second cover means being made from an absorbent material and being impregnated with a skin moisturizer.

2. The cuticle treatment apparatus of claim 1, said manicuring instrument being made of molded plastic and unitary in construction.

3. The cuticle treatment apparatus of claim 1, said first blade being substantially V-shaped, having inwardly tapering sides and a blunt end and said second blade being substantially U-shaped, having substantially parallel sides and an arcuate end.

4. The cuticle treatment apparatus of claim 1, said first and second blades having respective first faces which are gently concave in the lengthwise direction of said instrument and respective second faces which are gently convex in the lengthwise direction of said instrument.

5. The cuticle treatment apparatus of claim 1, said first and second cover means substantially conforming in shape to the shape of said first and second blades, respectively.

6. The cuticle treatment apparatus of claim 1, further comprising at least one pad means made of an absorbent material and impregnated with a skin moisturizer for softening the cuticle to be treated prior to use of said instrument.

7. Cuticle treatment apparatus comprising:

a manicuring instrument comprising an elongated shaft having opposed first and second ends and first and second blades extending from said first and second ends, respectively;

a plurality of first and second cover means for removably covering said first and second ends, respectively, said first and second cover means being made from an absorbent material and being impregnated with a skin moisturizer;

a plurality of pad means made from an absorbent material and being impregnated with a skin moisturizer for softening the cuticle to be treated prior to use of said instrument; and container means for holding said instrument, said plurality of first and second cover means, and said plurality of pad means.

8. The cuticle treatment apparatus of claim 7, said manicuring instrument being made of molded plastic and unitary in construction.

9. The cuticle treatment apparatus of claim 7, said first blade being substantially V-shaped, having inwardly tapering sides and a blunt end and said second blade being substantially U-shaped, having substantially parallel sides and an arcuate end.

10. The cuticle treatment apparatus of claim 7, said first and second blades having respective first faces which are gently concave in the lengthwise direction of said instrument and respective second faces which are gently convex in the lengthwise direction of said instrument.

11. The cuticle treatment apparatus of claim 7, said first and second cover means substantially conforming in shape to the shape of said first and second blades, respectively.

12. The cuticle treatment apparatus of claim 7, said container means comprising a base having a top surface having a recess formed therein at least in part conforming in shape to said instrument, said first and second cover means, and said pad means, and of sufficient depth for receiving said instrument, said plurality of first and second cover means, and said plurality of pad means.

13. The cuticle treatment apparatus of claim 12, said container means further comprising a lid for covering said base.

14. A method for treating cuticles, comprising:

providing a manicuring instrument having associated therewith means for continuously providing a skin moisturizer to the cuticle while the cuticle is being worked by the instrument;

providing at least one pad impregnated with a skin moisturizer;

softening the cuticle by massaging it with the pad for a period of time;

removing the pad; and simultaneously providing skin moisturizer to the cuticle and working the cuticle using the manicuring instrument and the associated moisturizer providing means.

15. The method of claim 14, further comprising applying additional skin moisturizer to the cuticle after said simultaneous providing and working step using the same pad.

16. The method of claim 14, further comprising applying additional skin moisturizer to the cuticle after said simultaneous providing and working step using another pad.

17. The method of claim 15, said applying step comprising massaging the cuticle with the pad.

18. The method of claim 16, said applying step comprising wiping the cuticle with the pad.

* * * * *